US005281195A

United States Patent [19]

Swartzbaugh

[11] Patent Number: 5,281,195

[45] Date of Patent: Jan. 25, 1994

[54] CENTRIFUGAL LIQUID CLEANING APPARATUS AND METHOD

[76] Inventor: Jim E. Swartzbaugh, 2402 Ardsheal Dr., La Habra Heights, Calif. 90631

[21] Appl. No.: 46,543

[22] Filed: Apr. 13, 1993

[51] Int. Cl.[5] ..... B04B 11/00

[52] U.S. Cl. ..... 494/37; 494/60

[58] Field of Search ..... 494/60, 37, 36, 43, 494/23, 30, 27, 85, 63, 67; 210/781, 782, 784; 422/72

[56] References Cited

U.S. PATENT DOCUMENTS

| | | | |
|---|---|---|---|
| 2,106,964 | 2/1938 | Wells | 494/29 |
| 2,394,015 | 2/1946 | Schutte | 429/27 |
| 2,782,925 | 2/1957 | Morton | 494/27 |
| 4,608,040 | 8/1986 | Knelson | 494/29 |

*Primary Examiner*—Robert W. Jenkins
*Attorney, Agent, or Firm*—Lyon & Lyon

[57] ABSTRACT

A centrifugal cleaning apparatus having a centrifuge bowl rotated on a vertical axis at high velocity with a circular opening in the top for clean liquid to be discharged into a surrounding liquid containment bowl. An accelerator is mounted in the bottom of the bowl for receiving contaminated liquid in the center of the accelerator and causing that liquid to be accelerated radially and rotationally into the centrifuge bowl. The centrifugal forces cause particulate material to be deposited on the vertical interior wall of the centrifuge bowl while the liquid flows from the bottom of the bowl to the outlet opening at the top in an annular column of liquid. The clean liquid is removed from the containment bowl and the collected particulate material is periodically removed from the centrifuge bowl.

31 Claims, 3 Drawing Sheets

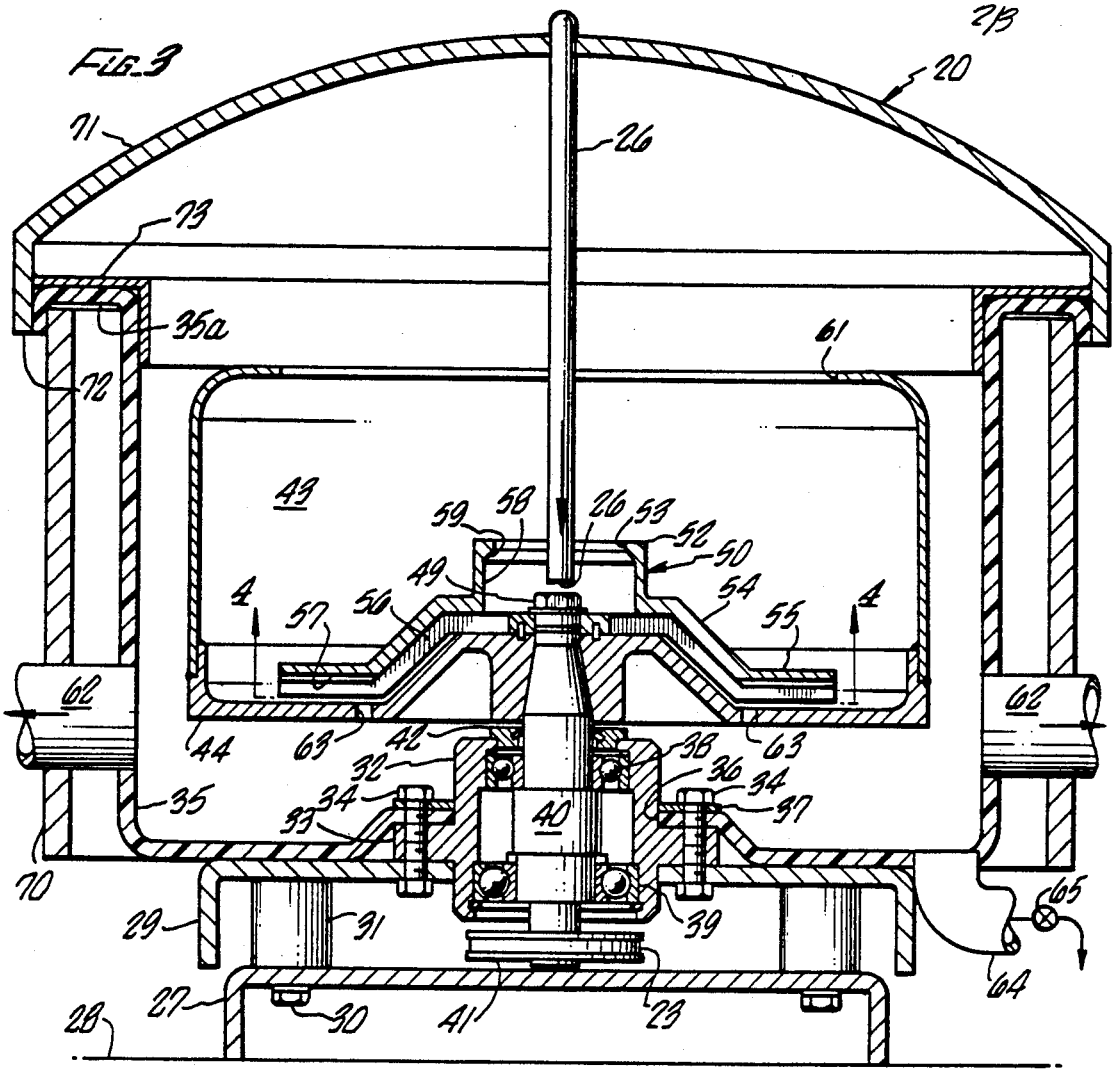
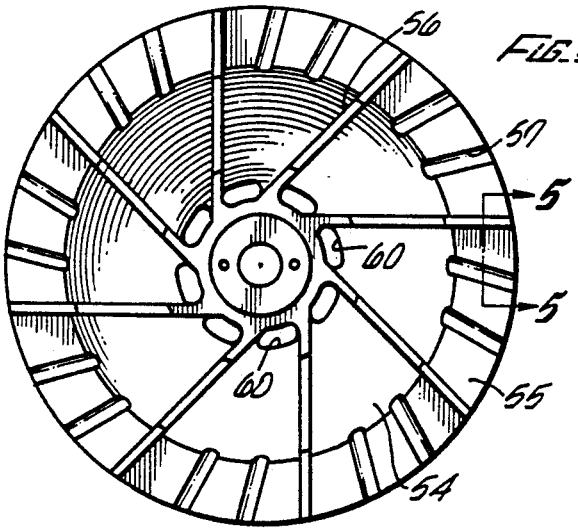
FIG. 4
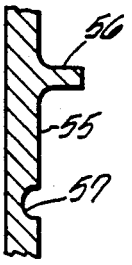
FIG. 5

CENTRIFUGAL LIQUID CLEANING APPARATUS AND METHOD

This invention relates to a method and apparatus for cleaning liquids that contain particulate matter by using centrifugal force and, in particular, to improvements in the efficiency and simplicity of high-speed centrifugal cleaning apparatus and methods for safe and effective industrial uses.

Centrifugal separating and cleaning devices are well known in the prior art for a great variety of uses from the separation of cream from milk to the separation of precious metals from cleaning solvents in modern industrial processes. The need for cleaning liquids, such as solvents or water, for either reusing or disposing of those liquids has become particularly important in view of rising costs of such liquids and environmental restrictions on the disposal of solvents and contaminated liquids. Because of increasingly strict disposal laws, this need exists even for small businesses that previously disposed of used liquids in municipal drain and sewage systems and disposed of unwanted particulate matter with other trash. While highly sophisticated centrifugal separating devices may accomplish the desired cleaning of liquids containing particulate matter for the desired purposes of (1) reusing the liquid, (2) disposing of the liquid, (3) recovering the particulate matter for reuse, (4) separating the particulate matter for proper disposal or processing, or (5) any combination of such purposes, such devices are too expensive to economically justify their use by smaller manufacturers or in separate individual processes used by larger manufacturers. Among the processes and machines that use a liquid that collects particulate material during use which material must be removed from the liquid are electric discharge machines, grinding machines, parts washers, cooling towers, silk screening processes, glass cutting processes, lapping machines, heat treating processes using oil, hydraulic fluids for various devices, metal plating processes that use fluids, etching processes and similar processes. While flow-through type filters have been successfully used for removing particulate matter in these machines and many of these processes, some such filters require disposal after a period of use, thereby creating another environmental problem, and other reusable type flow-through filters present substantial problems in cleaning the particulate matter from the filter.

It is an object of this invention to provide a centrifugal liquid cleaning apparatus and method that is both efficient and economical in cleaning the liquid and recovering the particulate matter.

It is another object of this invention to provide a centrifugal type liquid cleaning apparatus and method, wherein the liquid is introduced into a rotating bowl of the apparatus through a unique accelerator device and method to minimize the turbulence created by the liquid being introduced into the liquid being centrifuged to improve the separation of the particulate material from the liquid.

Another object of this invention is to provide a simple and inexpensive apparatus for cleaning particulate matter from liquids, wherein the apparatus has a minimal number of moving components to avoid wear and replacement problems.

Still another object of this invention is to provide a centrifugal type liquid cleaning apparatus for separating particulate matter from liquid that is usable for virtually any type of liquid and particulate matter without requiring different models, sizes, materials, speeds, etc.

It is still another object of this invention to provide a unique form of centrifugal liquid cleaning apparatus and process that will operate continuously for accepting a continuous supply of liquid and yet require only periodic removal of the separated particulate matter as the full capacity of particulate matter is reached, thereby avoiding the complexities of continuous removal of particulate matter.

Other and more detailed objects and advantages of this invention will appear to those skilled in the art in view of the following description of a preferred embodiment of this invention in connection with the accompanying drawings, wherein:

FIG. 3 is an enlarged sectional elevation view of a portion of the centrifugal liquid cleaning apparatus taken substantially on the line 3—3 in FIG. 1;

FIG. 4 is a bottom plan view of the accelerator portion of the centrifugal cleaning apparatus taken substantially on the line 4—4 in FIG. 3;

FIG. 5 is an enlarged fragmentary sectional view of the accelerator taken substantially on the line 5—5 in FIG. 4;

Figure 1:
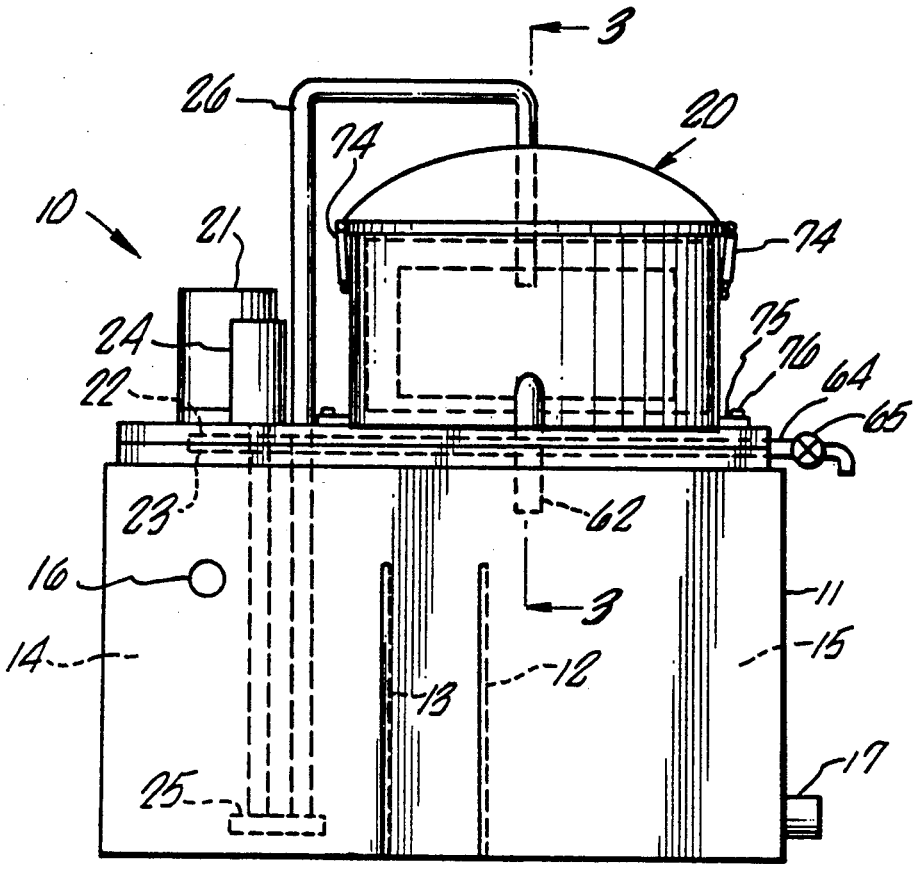
FIG. 1 is a diagrammatic elevation view of the centrifugal liquid cleaning apparatus of this invention.
Figure 2:
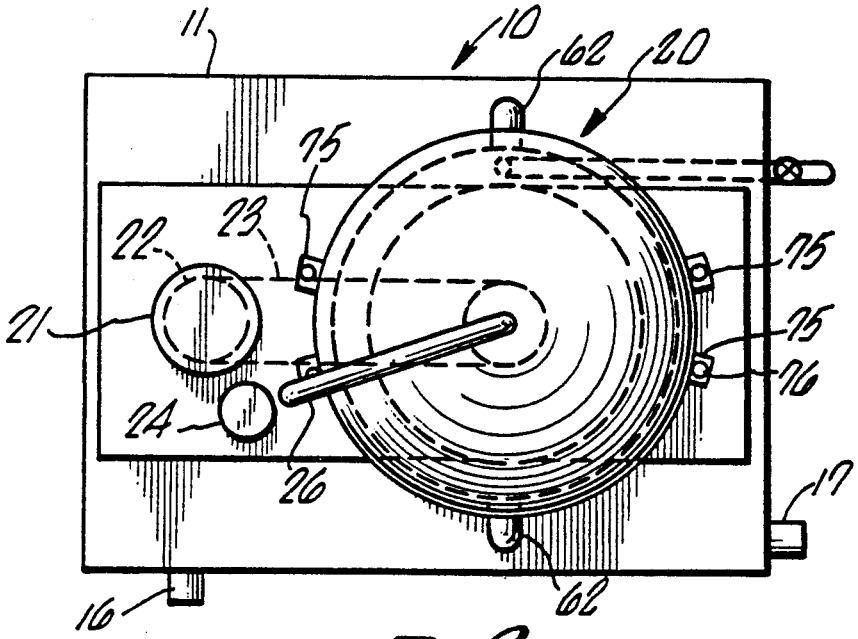
FIG. 2 is a top plan view of the centrifugal liquid cleaning apparatus illustrated in FIG. 1.

Referring now to FIGS. 1 and 2, in the preferred embodiment of the centrifugal liquid cleaning apparatus, generally designated 10, of this invention there is included a tank 11 having internal divider walls 12 and 13 for dividing the tank into two compartments, namely, a contaminated liquid compartment 14 and a clean liquid compartment 15 for conveniently supporting and containing all of the apparatus but it is to be understood that separate tanks for the clean and contaminated liquid may be provided separately and spaced from the operating apparatus which may be supported separately. An inlet 16 is provided for introducing the contaminated liquid into the compartment 14 from any outside source and an outlet 17 is provided for discharging clean liquid accumulated in the compartment 15. Appropriate valves (not shown) may be provided on the inlet 16 and outlet 17.

A centrifuge chamber assembly, generally designated 20, is mounted on top of the tank 11 and will be described later in more detail in connection with FIG. 3. An electric motor 21 is mounted on top of the tank 11 and is connected by drive means, such as a pulley 22 and V-belt 23, to the rotating component of the centrifuge chamber assembly 20. Another electric motor 24 drives a liquid pump having a pick-up or inlet 25 in the bottom of the contaminated liquid compartment 14, which inlet may include a screen or filter device, for pumping the contaminated liquid through a conduit 26 to the top of the centrifuge chamber assembly 20. It is to be understood that other types of motors, drives and pumps may be used for accomplishing these functions without departing from the invention and, in fact, the contaminated liquid may be supplied by gravity if the tank for such liquid is elevated above the centrifuge chamber assembly 20.

Referring now to FIG. 3, the centrifuge chamber assembly 20 and its components are shown in enlarged and greater detail in this sectional elevation which omits the supporting tank 11 for simplicity of illustration. A support channel 27 is mounted on the top 28 of the tank 11 and, in turn, a support bracket 29 is mounted on channel 27 by bolts 30 and vibration absorbing mounts 31. A bearing housing 32 having an integral flange 33 is mounted on the bracket 29 by a plurality of bolts 34 that extend through the flange 33 and bracket 29. In addition, the bolts 34 serve to mount a liquid containment bowl 35, having a central hole 36 for surrounding the bearing housing 32, to the bearing mount and bracket 29. A mounting ring 37 with holes for bolts 34 distributes the load of the bolt on the plastic material of which the liquid containment bowl 35 is formed.

The bearing housing 32 supports a pair of ball bearings 38 and 39 in spaced relationship, which bearings in turn support a shaft 40 for rotation on a vertical axis. A pulley 41 is mounted on the lower end of shaft 40 and is driven by the V-belt 23 from the pulley 22 and motor 21. A seal 42 is provided at the upper end of bearing housing 32 for sealing with shaft 40 to prevent liquid from entering the bearing housing 32.

A centrifuge bowl 43 is removably fixed to an upper portion of shaft 40, such as by a tapered interlock as shown. The centrifuge bowl 43 is comprised of a lower portion 44 that is a heavy casting for mounting on the shaft 40 and an upper portion 45 of steel formed by a spinning process, with the two portions permanently joined. The lower and upper portions 44 and 45 are constructed in a manner to withstand the extreme centrifugal forces generated by the high speeds of rotation of the centrifuge bowl 43 during operation of the apparatus and the centrifuge bowl 43 is carefully balanced to eliminate vibration caused by the high speed.

A centrifuge accelerator 50 is mounted at the upper end of shaft 40 on top of centrifuge bowl 43 with pins 51 for preventing relative rotation between the bowl 43 and accelerator 50. A wide flanged bolt 49 retains the accelerator 50 and bowl 43 on the shaft 40 for rotation therewith.

The accelerator 50 has an inverted-dish shape with an upper collar 52 having a central opening 53, an outwardly and downwardly inclined portion 54 connected to the upper collar 52, and a radial portion extending radially outwardly from the inclined portion 54 as shown in FIGS. 3, 4 and 5. The lower sides of the inclined portion 54 and radial portion 55 are provided with a plurality of fins 56 that project downwardly to a location closely spaced from the upwardly facing surfaces of the centrifuge bowl 43. The fins 56, eight of which are shown in the drawings, although a different number may be used, extend outwardly from the central portion of the accelerator 50 at an angle to a radial line drawn from the center of rotation which causes acceleration of the liquid in the rotational direction as the liquid flows outwardly from the center during rotation of the accelerator 50 and centrifuge bowl 43. The radial portion 55 of the accelerator 50 is also provided with a plurality of grooves 57, there being two grooves 57 between each pair of fins 56 in the drawings, along the bottom surface of radial portion 55 to assist in the acceleration and smooth flow of the liquid. The upper collar portion 52 of the accelerator 50 has an enlarged cylindrical surface 58 connected by a tapered portion 59 to the smaller diameter opening 53 at the top to inhibit the liquid discharged from the lower end 26a of the conduit 26 from escaping upwardly from the accelerator 50 and, as shown in FIG. 3, the lower end 26a is positioned below the tapered portion 59.

The accelerator 50 includes an opening 60 between each pair of fins 56 for allowing the liquid to flow from the inlet chamber formed by the cylindrical surface 58 downwardly through the openings 60 to the space between the fins 56 and then downwardly and outwardly along the downwardly facing walls of the inclined portion 54 and radial portion 55 of the accelerator as a result of the centrifugal force imposed on the liquid during rotation of the accelerator 50 and bowl 43. The outer extremities of openings 60 coincide with the cylindrical surface 58 for preventing any liquid from accumulating on and being retained by surface 58.

Figure 6:
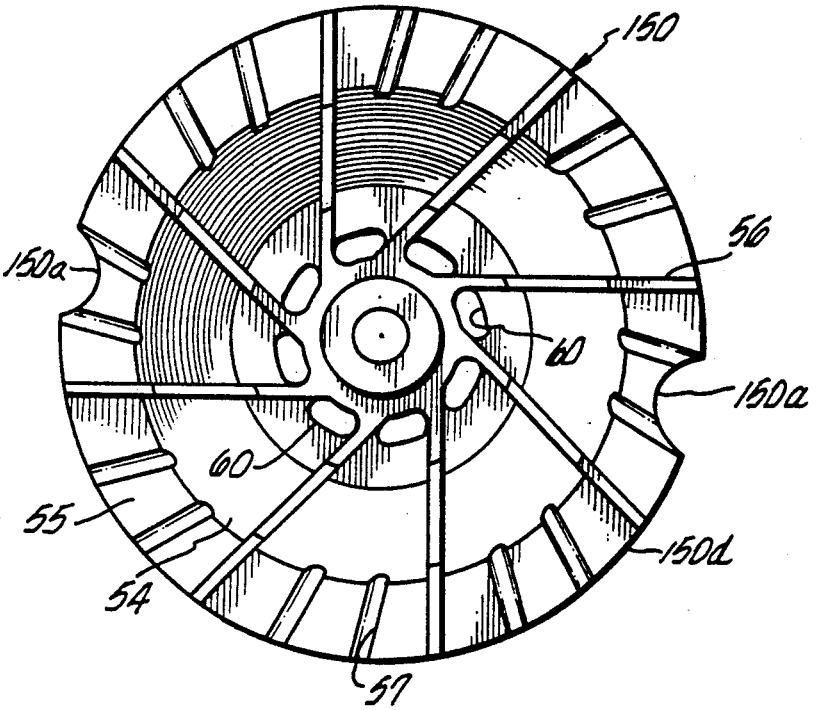
FIG. 6 is an enlarged fragmentary sectional elevation of a portion of the centrifugal liquid cleaning apparatus illustrated in FIG. 3 with the liquid shown in the appropriate positions during operation.

Referring now to FIG. 6, the liquid that flows along the downwardly facing walls of the accelerator 50 during rotation flows into an annular column C of the contaminated or dirty liquid, which column is formed as a result of the high centrifugal forces imposed by rotation of the accelerator 50 and centrifuge bowl 43 to form a virtually cylindrical inner surface Cs on the liquid which is equal to or slightly larger than a circular opening 61 in the top of the upper portion 45 of the centrifuge bowl 43. As additional liquid is introduced from the conduit 26 through the accelerator 50 to the column C to tend to cause the column C to grow inwardly, that is, for the surface Cs to move inwardly, the liquid spills out of the opening 61 in the upward direction and the centrifugal force throws that liquid outwardly to the wall of the liquid containment bowl 35 which forms a liquid containment chamber surrounding the centrifuge bowl 43. Thus, the contaminated liquid is introduced at the bottom of liquid column C by the accelerator 50 and progresses upwardly in the column C to the outlet opening 61 during which time the centrifugal force imposed by the rotation of the centrifuge bowl 43 causes the particulate material P to be deposited on the vertical inner wall of the centrifuge bowl 43. As the particulate material P accumulates on the inner wall of centrifuge bowl 43, the volume of liquid in the column C is reduced but the liquid continues to flow from the bottom of the bowl 43 to the outlet opening 61 while the particulate material P continues to build on the wall of bowl 43 without exiting the opening 61. The liquid is introduced by pump 25 and conduit 26 at a predetermined rate and, therefore, the time period during which the liquid is subjected to centrifugal forces depends on the volume of flowing liquid in column C which inversely depends on the volume of particulate material deposited on the inner wall of centrifuge bowl 43. Thus, the bowl must be cleaned periodically to remove particulate material.

The clean liquid discharged from opening 61 in centrifuge bowl 43 impinges on the surrounding wall of containment bowl 35 and flows to the bottom of containment bowl 35 to form a body B of clean liquid having an upper surface Bs. The clean liquid B flows out of the containment bowl 35 through a pair of liquid return lines 62 on opposite sides of the bowl 35 at level of surface Bs, which lines 62 then extend downwardly into the clean liquid compartment 15 of the tank 11 as shown in FIGS. 1 and 2.

Thus, the apparatus 10 can operate continuously to centrifugally separate particulate material from liquid introduced through conduit 26, which particulate matter accumulates on the vertical interior wall of centrifuge bowl 43 while the clean liquid flows out the opening 61 into the containment bowl 35 and then out the lines 62 to the clean liquid compartment 15. Periodically, when the amount of particulate material P that has collected on the interior wall of centrifuge bowl 43 becomes so great that the volume of actual liquid in column C is substantially reduced, thereby reducing the amount of time that the liquid remains in column C for centrifuging between the bottom of bowl 43 and the outlet opening of 61, the pump motor 24 is de-energized to stop the flow of contaminated liquid to the centrifuge chamber assembly 20 and the motor 21 is de-energized to stop the rotation of the centrifuge bowl 43 and accelerator 50. Any fluid remaining in the centrifuge bowl 43 when it comes to rest will drain through openings 63 in the bottom of the centrifuge bowl, which openings 63 are located substantially inwardly from the column surface Cs so that fluid does not flow out of the opening 63 during rotation of the bowl 43. It should be noted, that the centrifugal force causes the liquid introduced through conduit 26 to flow along the downwardly facing surfaces of the accelerator 50 whereby the liquid never reaches the drain openings 63 in the bottom of bowl 43 during rotation of the centrifuge bowl 43. A drain pipe 64 with a valve 65 is connected to the bottom of containment bowl 35 for periodically draining all of the fluid from containment bowl 35 when the centrifuge bowl 43 is stopped. This allows any contaminated liquid from centrifuge bowl 43 to drain through openings 63 and out drain pipe 64, together with any contaminants that may have settled in the bottom of containment bowl 35 during operation of the centrifuge apparatus. The centrifuge bowl 43 and accelerator 50 are removed from the shaft 40 and then the particulate material P accumulated on the interior wall of the bowl 43 is removed by an appropriate procedure depending on the type of particulate matter. The accelerator 50 may also be cleaned in the event that the column of particulate matter P was sufficiently flowable to touch the accelerator 50 when the centrifuge bowl 43 and accelerator 50 were stopped. Further, the containment bowl 35 may be cleaned before replacing the centrifuge bowl 43 and accelerator 50, whereupon the valve 65 may be closed again for resuming operation of the centrifugal liquid cleaning apparatus 10 of this invention.

Again referring to FIG. 3, a cylindrical steel shell 70 is positioned on top of the bracket 29 and surrounds the plastic liquid containment bowl 35 for most of the height of the bowl. The liquid containment bowl 35 has a flange **35*a* at its upper, open end, which flange extends outwardly and then downwardly over the outside of shell 70. The cylindrical shell 70 is anchored to the bracket 29 by a plurality of outwardly extending lugs 75 affixed to the shell 70 and bolts 76. A dome-shaped lid 71 has a downwardly extending cylindrical portion 72 at its outer periphery and an annular ring 73 mounted on the interior of portion 72 to form a downwardly facing annular pocket for surrounding and sealing against the flange 35*a* of containment bowl 35. The lid 71 is removably secured to the cylindrical shell 70 by any convenient means, such as a plurality of over-center type latches 74. The conduit 26 for supplying contaminated liquid to the accelerator 50 passes through a hole in the lid 71. Thus, the rotating centrifuge bowl 43 and accelerator 50 are completely surrounded by the shell 70 on the side, lid 71 on the top and tank 11** on the bottom.

Figure 7:
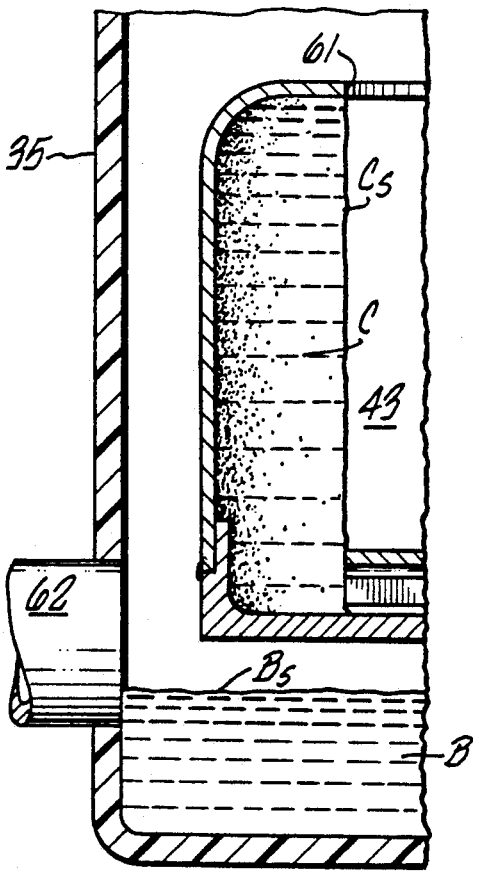
FIG. 7 is a bottom elevation view similar to FIG. 4 of a modified form of the accelerator.
Figure 8:
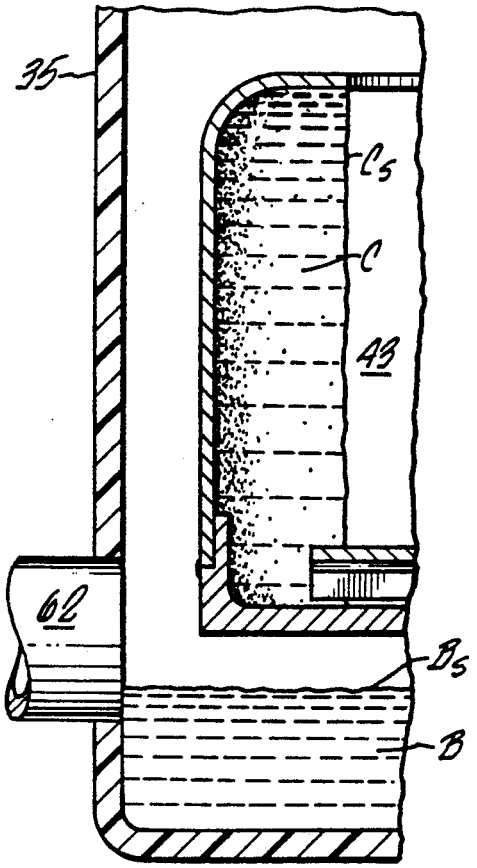
FIG. 8 is an elevation view similar to FIG. 6 but illustrating the apparatus in operation with the modified embodiment of the accelerator illustrated in FIG. 7.

Referring now to FIGS. 7 and 8, a modified form of accelerator 150 is shown which differs from accelerator 50 shown in FIGS. 3–6 only in the provision of a pair of diametrically opposed cut-out portions **150*a* in the radial portion 55 and in the outside diameter 150*d* of the radial portion 55. In all other respects, the accelerator 150 is identical to accelerator 50 and, therefore, has been so numbered and will not be redescribed. The outside diameter 150*d* of accelerator 150 is larger than the diameter of outlet opening 61 in the centrifuge bowl 43 and, therefore, the provision of the diametrically opposed cut-outs 150*a* is necessary for purposes of installing and removing the accelerator 150 from centrifuge bowl 43. In other words, a cut-out portion 150*a* is positioned on the edge of opening 61 with the rotational axis of the accelerator 150 at a substantial angle to the rotational axis of the centrifuge bowl 43 and then the accelerator 150 can be pivoted about that point of contact to pass through the opening 61 even though the diameter 150*d* of the remaining portion of the accelerator 150 is larger than the inside diameter of opening 61. Two cut-out portions 150*a* are provided to maintain the balance of accelerator 150 for rotational purposes. In contrast, the accelerator 50 is of a diameter only slightly smaller than the opening 61, whereby it may be installed or removed from the centrifuge bowl 43 in either an axial or tilted direction. The accelerator 150 functions differently than the accelerator 50 only in that because of its larger outside diameter 150*d* the radial portion 55 extends into the column C of liquid below the surface Cs. This reduces the turbulence that is otherwise generated in the columns C of liquid as the liquid is introduced from the accelerator 150 because the liquid flows along the surface of the accelerator 150 directly into the column C of liquid without being discharged through the air in the small gap between the accelerator and the surface Cs that occurs with the smaller accelerator 50**.

Without intending to limit the scope of the present invention but rather for purposes of clearly disclosing the sizes, proportions, shapes, operating parameters, etc. that have been found successful in operation, now the construction of a specific device will be described. In an operating device as disclosed above, the centrifuge bowl 43 was approximately 12" in diameter and the opening 61 was approximately 8" in diameter. In the accelerator 50, the inclined portion 54 was inclined at an angle of 45° to the axis of rotation, eight fins 56 of a height of 0.500" were provided as shown, sixteen grooves 57 of a depth of 0.125" and a width of 0.250" were provided as shown, and a cylindrical inlet chamber having a cylindrical wall 58 of approximately 2.5" diameter and 1" tall was provided. The accelerator 50 was of cast Manganese-Bronze by rotating the centrifuge bowl 43 and accelerator 50 at 4400 rpm, this centrifugal liquid cleaning apparatus 10 is able to process approximately 22 gallons of liquid per minute and remove solid particulate material P of a size down to less than 5 microns and even down to 1 micron or less with respect to some solids, which is an extremely efficient and effective filtration rate for such a small and economical unit.

It is believed that the apparatus of this invention is particularly effective because of the design of the accelerator 50 which provides fluid impeller chambers or passages between the fins 56 that cause the liquid to be accelerated both outwardly and rotationally which in turn accelerates the particulate material. Under Coriolis' Law the total acceleration of a liquid particle at any given moment is the vector sum of (1) the acceleration of the particle resulting from the velocity "v" that the particle would have along the path if the path were not rotating, (2) the acceleration particle would have if it were fixed on the path and the path is rotated at an angular velocity "w", and (3) a compound supplementary acceleration equal to 2 (v)(w). The sense of this latter component, known as the "Coriolis Component" is that if viewed as a force, it would tend to rotate the vector "u" in the sense of "w". The path is curved such that the exit velocity vector from an impeller is tangential to the centrifuge bowl and then the Coriolis Component will tend to rotate that vector beyond tangential. In this invention, it is believed that the normal component of velocity of the impeller output stream contracting the centrifuge bowl 34 wall is maintained to increase the impact separation of the more dense impurities in the liquid. Since these impurities will have an increased momentum associated with their mass, a downward impact velocity component may desirably result which will tend to cast the heavier impurities toward the bottom of the centrifuge bowl, while the cleaner liquid progresses up the centrifuge bowl to the outlet opening 61. It is believed that a tangential component of velocity is maintained which reduces the energy loss associated with slippage between the slower velocity stream and the wall. However, obviously these theories of operation have not actually been observed in view of the fact that the centrifuge bowl 43 and accelerator 50 are rotating at such high speeds during operation.

While a specific construction of a preferred embodiment of a centrifugal liquid cleaning apparatus 10 of this invention has been shown and described, it will readily appear to those skilled in the art that various modifications can be made to the shapes and relative sizes of the components without departing from the spirit of the invention as set forth in the following claims.

What is claimed:

1. A centrifugal liquid cleaning apparatus, comprising, a rotatably mounted bowl, said bowl having a cylindrical wall with a closed end and a partially open end at opposite ends of said cylindrical wall, said open end having a circular central opening concentric with and smaller than said cylindrical wall, means for causing high speed rotation of said bowl on an axis concentric with said cylindrical wall for causing liquid in the bowl to be forced into an annular column with excess liquid being discharged through said central opening, an accelerator means in said closed end with means for receiving liquid to be cleaned substantial at said axis, said accelerator means having a surface extending outwardly relative to said axis with an outer diameter approximately the diameter of said circular central opening, said surface having means for imparting movement to the liquid in said direction of rotation and conducting the liquid from said axis to said annular column.

2. The centrifugal liquid cleaning apparatus of claim 1, wherein said accelerator surface includes a portion positioned at substantially 45° relative to said axis and said surface faces said closed end of said bowl.

3. The centrifugal liquid cleaning apparatus of claim 2, wherein said closed end of said bowl includes a surface closely spaced from said accelerator surface for confining the liquid between the two said surfaces.

4. The centrifugal liquid cleaning apparatus of claim 1,2 or 3, wherein a plurality of fins are provided on said accelerator surface, said fins extending from adjacent said means for receiving liquid to said outer diameter of the accelerator means.

5. The centrifugal liquid cleaning apparatus of claim 4, wherein said fins extend circumferentially at an angle to a radius from the axis for accelerating the liquid in a circumferential direction.

6. The centrifugal liquid cleaning apparatus of claim 5, wherein said angle is substantial 45° at an inner end of each fin adjacent said means for receiving liquid and each said fin being substantially straight from said inner end to said outer diameter.

7. The centrifugal liquid cleaning apparatus of claim 4, wherein said accelerator means includes a plurality of ports adjacent said means for receiving liquid for the liquid to flow to said accelerator surface with one said port provided between each pair of fins.

8. The centrifugal liquid cleaning apparatus of claim 1, 2 or 3, wherein said accelerator surface includes a radially extending portion adjacent said outer diameter.

9. The centrifugal liquid cleaning apparatus of claim 8, wherein a plurality of fins are provided on said accelerator surface, said fins extending from adjacent said means for receiving liquid to said outer diameter of the accelerator means.

10. The centrifugal liquid cleaning apparatus of claim 8, wherein said radially extending portion of said accelerator surface includes a plurality of grooves extending in a radial and circumferential direction relative to said axis.

11. The centrifugal liquid cleaning apparatus of claim 8, wherein said radially extending portion of said accelerator surface includes a plurality of grooves extending in a radial and circumferential direction relative to said axis, a plurality of fins are provided on said accelerator surface, said fins extending from adjacent said means for receiving liquid to said outer diameter of the accelerator means, and a pair of said grooves is provided between each pair of fins.

12. The centrifugal liquid cleaning apparatus of claim 1, wherein said bowl is comprised of a heavy base forming said closed end and a thin walled shell forming said cylindrical wall and open end with said central opening, said base and shell being welded together.

13. The centrifugal liquid cleaning apparatus of claim 1 or 12, wherein said accelerator means is a cast member, means releasably connecting said accelerator means to said bowl for preventing relative rotation therebetween.

14. The centrifugal liquid cleaning apparatus of claim 1, wherein a containment chamber is provided and surrounds said bowl for receiving the liquid discharged from said circular central opening.

15. The centrifugal liquid cleaning apparatus of claim 14, wherein a thick steel shell is provided and surrounds said containment chamber.

16. The centrifugal liquid cleaning apparatus of claim 14, wherein a clean liquid outlet is provided in a side wall of said containment chamber spaced above a bottom of said containment chamber for removing clean liquid from said containment chamber and allowing any particulate material to settle to said bottom of the containment chamber by gravity.

17. The centrifugal liquid cleaning apparatus of claim 16, wherein a selectively operable dirty liquid outlet is provided in said bottom of the containment chamber.

18. The centrifugal liquid cleaning apparatus of claim 1, wherein said axis is oriented substantially vertically and said closed end of the bowl is on the bottom, and drain hole means provided in said closed end radially spaced inwardly of the inner extremity of the annular column of liquid for only draining liquid from said bowl when the bowl is not rotating.

19. The centrifugal liquid cleaning apparatus of claim 1, 2 or 3 wherein said accelerator means outer diameter is larger than said diameter of said circular central opening.

20. The centrifugal liquid cleaning apparatus of claim 19, wherein diametrically located cut-out portions are provided at the outer diameter of said accelerator means for allowing installation and removal of said accelerator means through said circular central opening.

21. A centrifugal liquid cleaning apparatus, comprising, a rotatably mounted bowl and means for causing high speed rotation of said bowl on an axis, said bowl having a cylindrical wall concentric with said axis, a closed end and an open end at opposite ends of said cylindrical wall, said open end having a circular central opening concentric with said axis and smaller in diameter than said cylindrical wall with a flange portion extending from said cylindrical wall to said circular opening for retaining an annular column of the liquid in the bowl during said rotation with excess liquid being discharged through said central opening, said bowl having an accelerator means in said closed end with means for receiving liquid to be cleaned substantial at said axis, said accelerator means including means for forming passage means extending outwardly relative to said axis to an outward extremity adjacent said closed end at a diameter at least substantially as large as the diameter of said circular central opening for conducting the liquid from said axis to said annular column in a manner for minimizing turbulence in said annular column for particulate material in said liquid to be deposited on said cylindrical wall while the liquid progresses from said closed end to said open end and out said circular central opening, and a containment chamber surrounding said bowl for receiving the liquid discharged from said circular central opening during said rotation.

22. The centrifugal liquid cleaning apparatus of claim 21, wherein said passage means of said accelerator means includes a portion positioned at substantially 45° relative to said axis.

23. The centrifugal liquid cleaning apparatus of claim 21, wherein said passage means is formed by said closed end of said bowl and a surface on said accelerator surface closely spaced from said closed end for confining the liquid between the two said surfaces.

24. The centrifugal liquid cleaning apparatus of claim 21, 22 or 23, wherein said passage means includes a plurality of fins on said accelerator means, said fins extending from adjacent said means for receiving liquid to said outer diameter of the accelerator means.

25. The centrifugal liquid cleaning apparatus of claim 24, wherein said fins extend circumferentially at an angle to a radius from the axis for accelerating the liquid in a circumferential direction.

26. The centrifugal liquid cleaning apparatus of claim 21 or 22, wherein said accelerator surface includes a radially extending portion adjacent said outer diameter.

27. The centrifugal liquid cleaning apparatus of claim 26, wherein a plurality of fins are provided on said accelerator surface, said fins extending from adjacent said means for receiving liquid to said outer diameter of the accelerator means.

28. A method of centrifugally cleaning a liquid, comprising the steps of rotating a bowl at a high speed, introducing the liquid into a central inlet port on an axis of rotation of the rotating bowl, causing the liquid to be accelerated to the rotational speed of the bowl by radially and circumferentially directing the liquid from the central inlet port to an internal cylindrical surface of the bowl at one end of the bowl, and confining an angular column of the liquid in the bowl on the internal cylindrical surface by the centrifugal force of rotation with the one end of the bowl being closed and the other end of the bowl having a central circular outlet opening of the diameter of the inside surface of the annular column for causing the liquid being introduced to the annular column to progress from the one end to the other end and be discharged as cleaned liquid through the outlet with the particulate material being deposited on the internal cylindrical surface of the bowl by the centrifugal force.

29. The method of centrifugally cleaning a liquid of claim 28, including, in the step of accelerating the liquid, causing the accelerated liquid to be confined in the radial direction until at least substantially the location of the inside of the annular column for minimizing turbulence in the annular column of liquid.

30. The method of centrifugally cleaning a liquid of claim 28 or 29, including the step of collecting the clean liquid discharged from the central circular outlet opening in a containment chamber surrounding the rotating bowl.

31. The method of centrifugally cleaning a liquid of claim 28 or 29, including the step of stopping the rotating bowl and flow of liquid to the rotating bowl, and removing the particulate material from the internal cylindrical surface when the amount of deposited particulate material reduces the amount of liquid in the annular column to a degree rendering the filtration ineffective because the liquid is subjected to the centrifugal for an insufficient time period.

* * * * *